US008944040B2

(12) United States Patent
Liao

(10) Patent No.: US 8,944,040 B2
(45) Date of Patent: Feb. 3, 2015

(54) PRESSURE DIFFERENTIAL BULLET ADVANCING STRUCTURE OF TOY GUN

(71) Applicant: Guay Guay Trading Co., Ltd., New Taipei (TW)

(72) Inventor: Yin-Hsi Liao, New Taipei (TW)

(73) Assignee: Guay Guay Trading Co., Ltd., New Taipei (TW)

( * ) Notice: Subject to any disclaimer, the term of this patent is extended or adjusted under 35 U.S.C. 154(b) by 83 days.

(21) Appl. No.: 13/894,441

(22) Filed: May 15, 2013

(65) Prior Publication Data

US 2014/0305419 A1 Oct. 16, 2014

(30) Foreign Application Priority Data

Apr. 15, 2013 (TW) ..... 102206778 U

(51) Int. Cl.
*F41B 11/62* (2013.01)
*F41B 11/60* (2013.01)

(52) U.S. Cl.
CPC ..... *F41B 11/60* (2013.01)
USPC ..... 124/73

(58) Field of Classification Search
CPC ..... F41B 11/62; F41B 11/57; F41B 11/89; F41B 11/72; F41A 21/482
USPC ..... 124/71–77, 60, 64–69
See application file for complete search history.

(56) References Cited

U.S. PATENT DOCUMENTS

| | | | | | |
|---|---|---|---|---|---|
| 2,225,629 | A * | 12/1940 | Fraser | 124/27 |
| 2,634,717 | A * | 4/1953 | Junkin | 124/75 |
| 5,193,517 | A * | 3/1993 | Taylor et al. | 124/67 |
| 7,305,980 | B2 * | 12/2007 | Liao | 124/31 |
| 7,316,565 | B2 * | 1/2008 | Liao | 434/18 |
| 7,337,774 | B2 * | 3/2008 | Webb | 124/60 |
| 7,392,803 | B2 * | 7/2008 | Liao | 124/83 |
| 7,886,732 | B1 * | 2/2011 | Liao | 124/74 |
| 7,931,017 | B2 * | 4/2011 | Liao | 124/74 |
| 2010/0291514 | A1 * | 11/2010 | Liao | 434/23 |
| 2011/0003268 | A1 * | 1/2011 | Liao | 434/16 |
| 2013/0122470 | A1 * | 5/2013 | Liao | 434/22 |
| 2014/0051328 | A1 * | 2/2014 | Liao | 446/473 |
| 2014/0246004 | A1 * | 9/2014 | Liao | 124/51.1 |
| 2014/0251296 | A1 * | 9/2014 | Flint et al. | 124/57 |

* cited by examiner

*Primary Examiner* — Michael David
(74) *Attorney, Agent, or Firm* — Leong C. Lei

(57) ABSTRACT

The present invention provides a pressure differential bullet advancing structure for advancing BB bullets, which includes an expansion device, a collar device that is slidably received in the expansion device, and a pneumatic module arranged at one side of the expansion device. The expansion device includes a guide bar that is received in the collar device. The guide bar has a circumferential wall forming an air inlet opening that is extended in a direction away from the pneumatic module and is selectively shielded by the collar device. The pneumatic device generates high-pressure air that flows through the expansion device to move the collar device for advancing the BB bullet. When the collar device is moved to such an extent that the air inlet opening is exposed, the high-pressure air flows therethrough to shoot out the BB bullet.

10 Claims, 8 Drawing Sheets

PRESSURE DIFFERENTIAL BULLET ADVANCING STRUCTURE OF TOY GUN

TECHNICAL FIELD OF THE INVENTION

The present invention generally relates to a pressure differential bullet advancing structure of toy gun that reduces cost, reduces the amount of interior space needed, reduces the chance of malfunctioning, makes assembling/disassembling easy, and reduces the loading of power device.

DESCRIPTION OF THE PRIOR ART

Referring to FIGS. 1A and 1B, schematic views of a shooting system of a conventional toy gun are shown. These drawings clearly show that the conventional toy gun shooting system comprises a motor (not labeled in the drawings), a gear train module 91 operatively coupled to the motor, a cylinder module 92 operatively coupled to the gear train module 91, an air collection device 93 arranged at one side of the cylinder module 92, a bullet advancing element 94 that is slidably fit over a portion of the air collection device 93 that is distant from the cylinder module 92, and a transmission link member 95 operatively coupled to the gear train module 91. The transmission link member 95 is set in engagement with and moves the bullet advancing element 94 forward so as to have the bullet advancing element 94 to advance a BB bullet forward.

To put the conventional toy gun shooting system into operation, the motor is first activated to drive the gear train module 91 to operate. The gear train module 91 drives, via the transmission link member 95, the bullet advancing element 94 to advance the BB bullet forward. Simultaneously, the gear train module 91 drives the cylinder module 92 to move forward in order to provide a force for shooting out the BB bullet. However, the gear train module 91 is spaced from the bullet advancing element 94 by a certain distance and thus, the transmission link member 95 must be of a length that is at least equal to such a distance. Further, the transmission link member 95 must be of a predetermined mechanical strength (being of a sufficient thickness or width) in order to drive the bullet advancing element 94, and consequentially, the transmission link member 95 requires quite an amount of space for installation. Further, due to the substantial length, the transmission link member 95 is easier to break. In addition, assembling and disassembling is complicated and difficult. When the gear train module 91 is designed as having a quick assembling/disassembling structure, it often causes difficult of assembling and coordination among components. In addition to the power supplied to operate the cylinder module 92, the motor also needs to provide power for moving the transmission link member 95 and this leads to an increase of the loading of the motor.

SUMMARY OF THE INVENTION

The object of the present invention is to reduce the number of components/parts used and the amount of space occupied thereby, reduce the occurrence of breaking, make it easy to assemble and disassemble, and reduce the loading of power device.

The structure of the present invention comprises an expansion device. The expansion device slidably receives therein a collar device. A pneumatic module is arranged at one side of the expansion device. The expansion device comprises at least one guide bar that is distant from the pneumatic module to be partially received in the collar device. The guide bar has a circumferential wall forming at least one air inlet opening and the air inlet opening is extended in a direction away from the pneumatic module to allow high-pressure air to flow therethrough. The air inlet opening is selectively shielded by the collar device. When the invention is put into operation, the pneumatic module quickly moves forward to generate high-pressure air, which flows through the expansion device to apply a force to the collar device to cause the collar device to displace for moving a BB bullet to a ready-to-shoot position. With the collar device further displacing forward to expose the air inlet opening, the high-pressure air is allowed to flow through the air inlet opening toward the end of the expansion device that is distant from the pneumatic module to shoot the BB bullet.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1A:
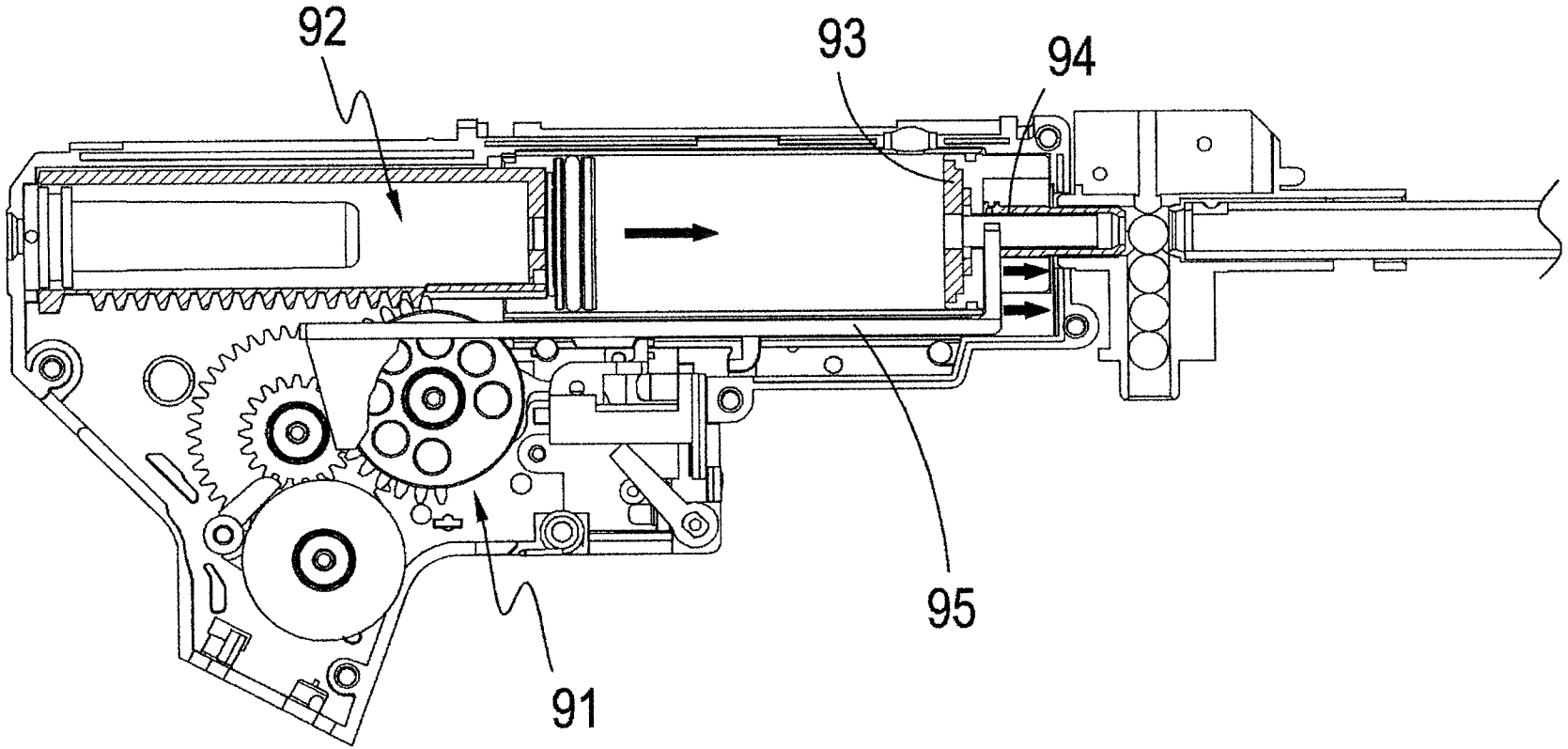
FIG. 1A is a schematic view showing a conventional toy gun shooting system.
Figure 1B:
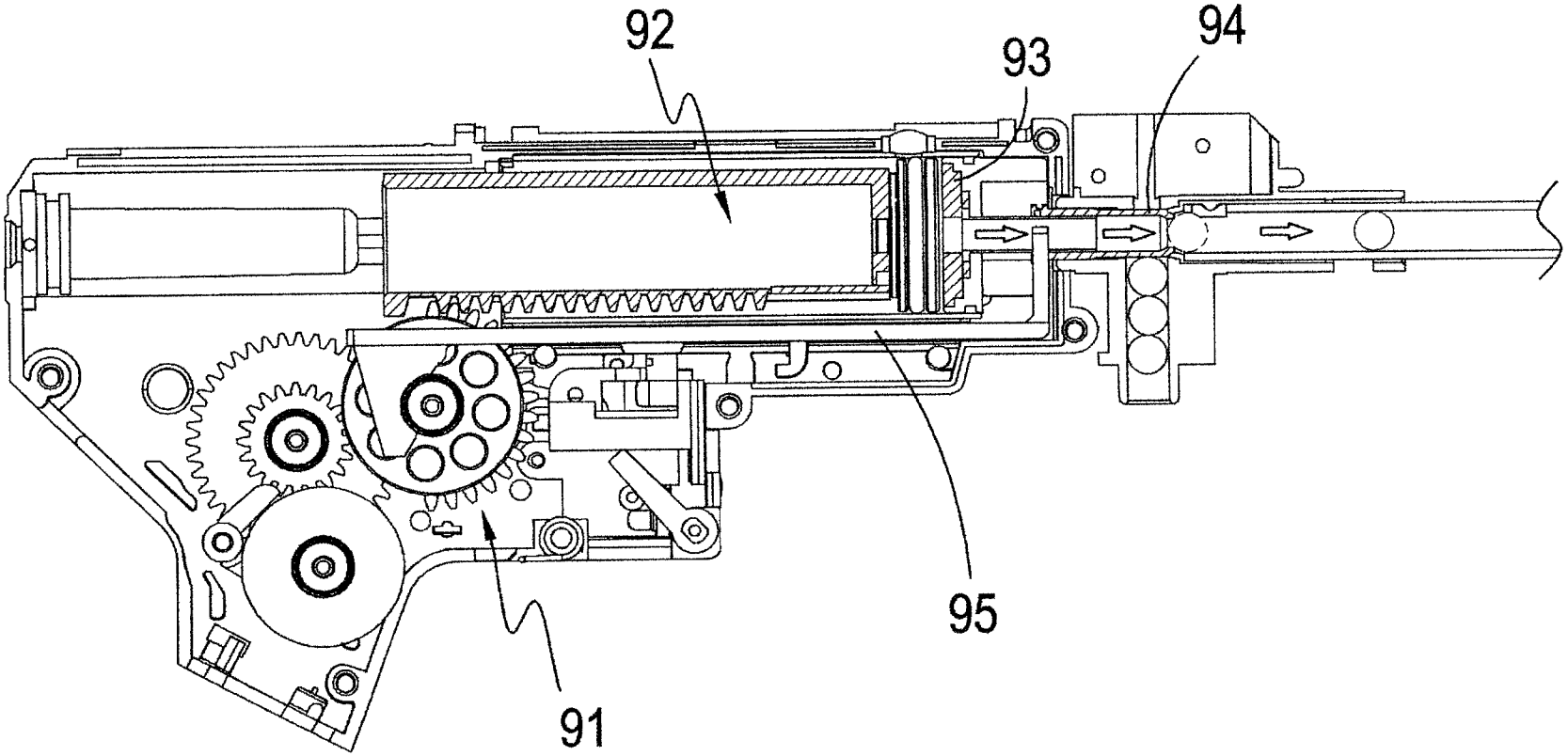
FIG. 1B is another schematic view showing the conventional toy gun shooting system.
Figure 2A:
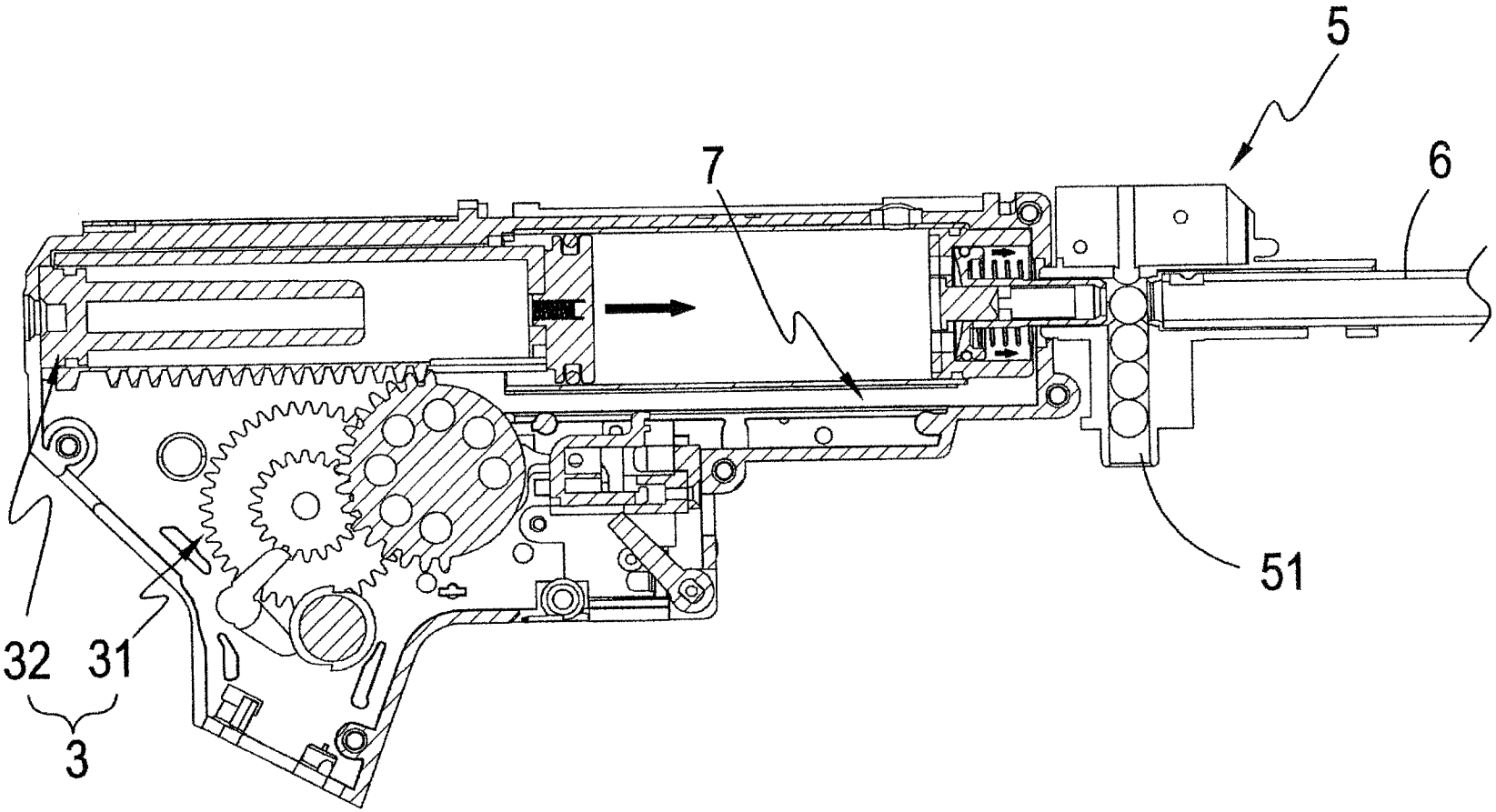
FIG. 2A is a schematic view showing an embodiment of the present invention.
Figure 2B:
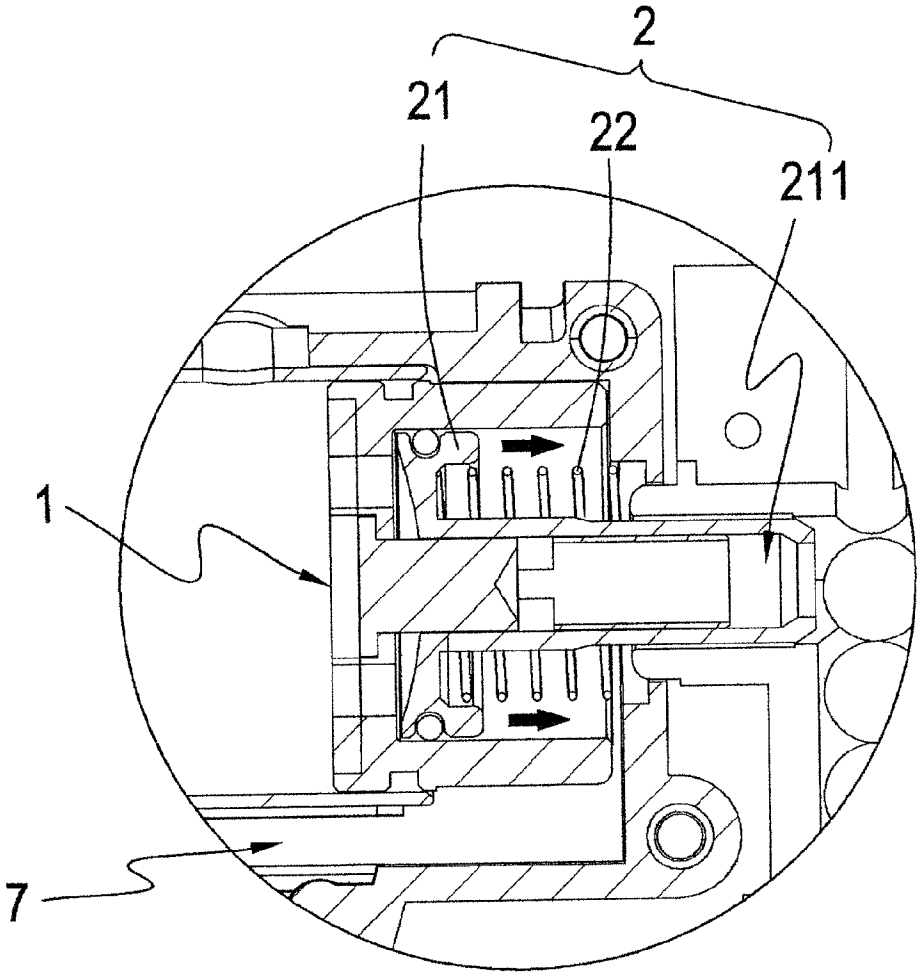
FIG. 2B is an enlarged view of the embodiment of the present invention.
Figure 2C:
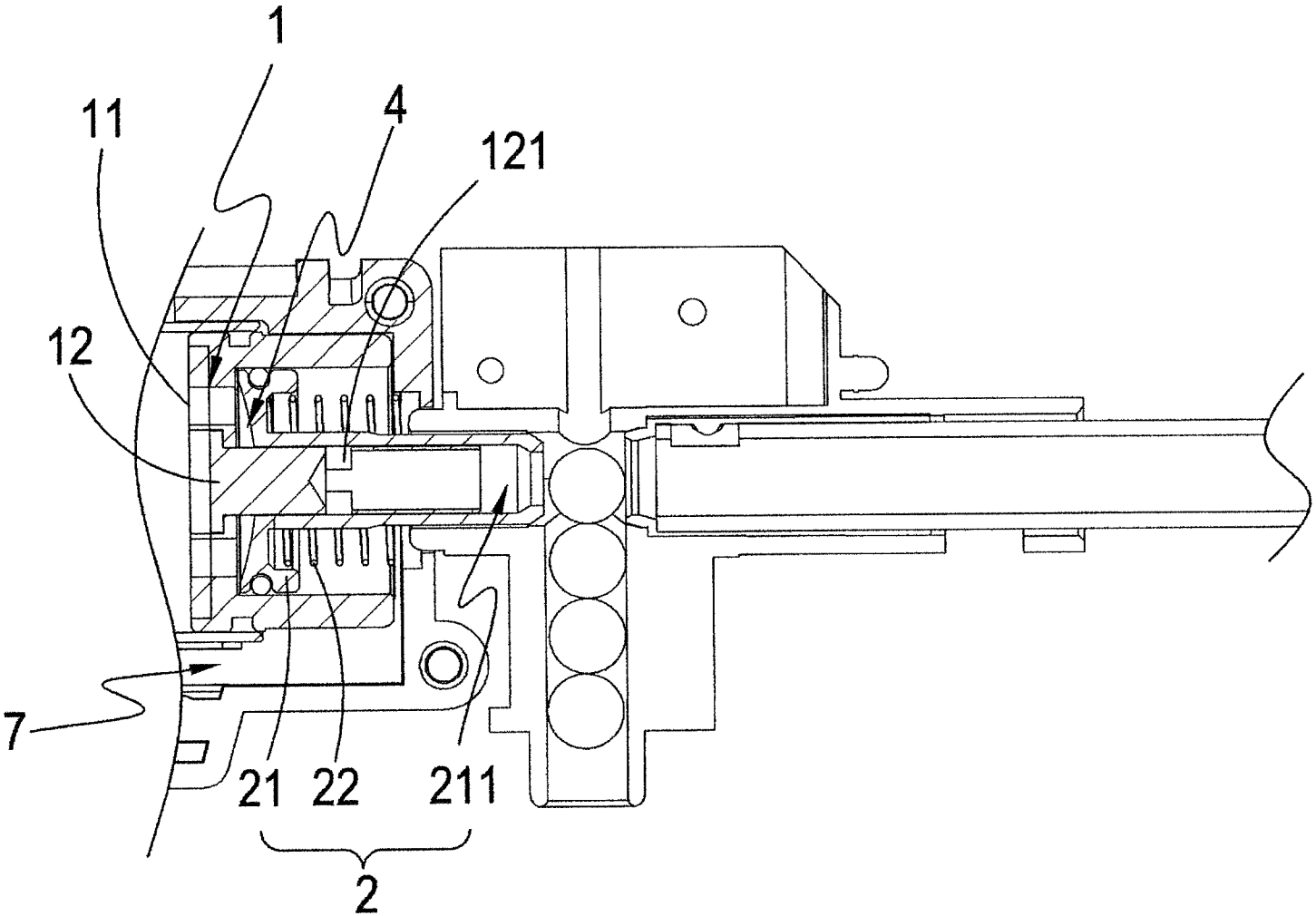
FIG. 2C is a partial schematic view of the embodiment of the present invention.
Figure 3A:
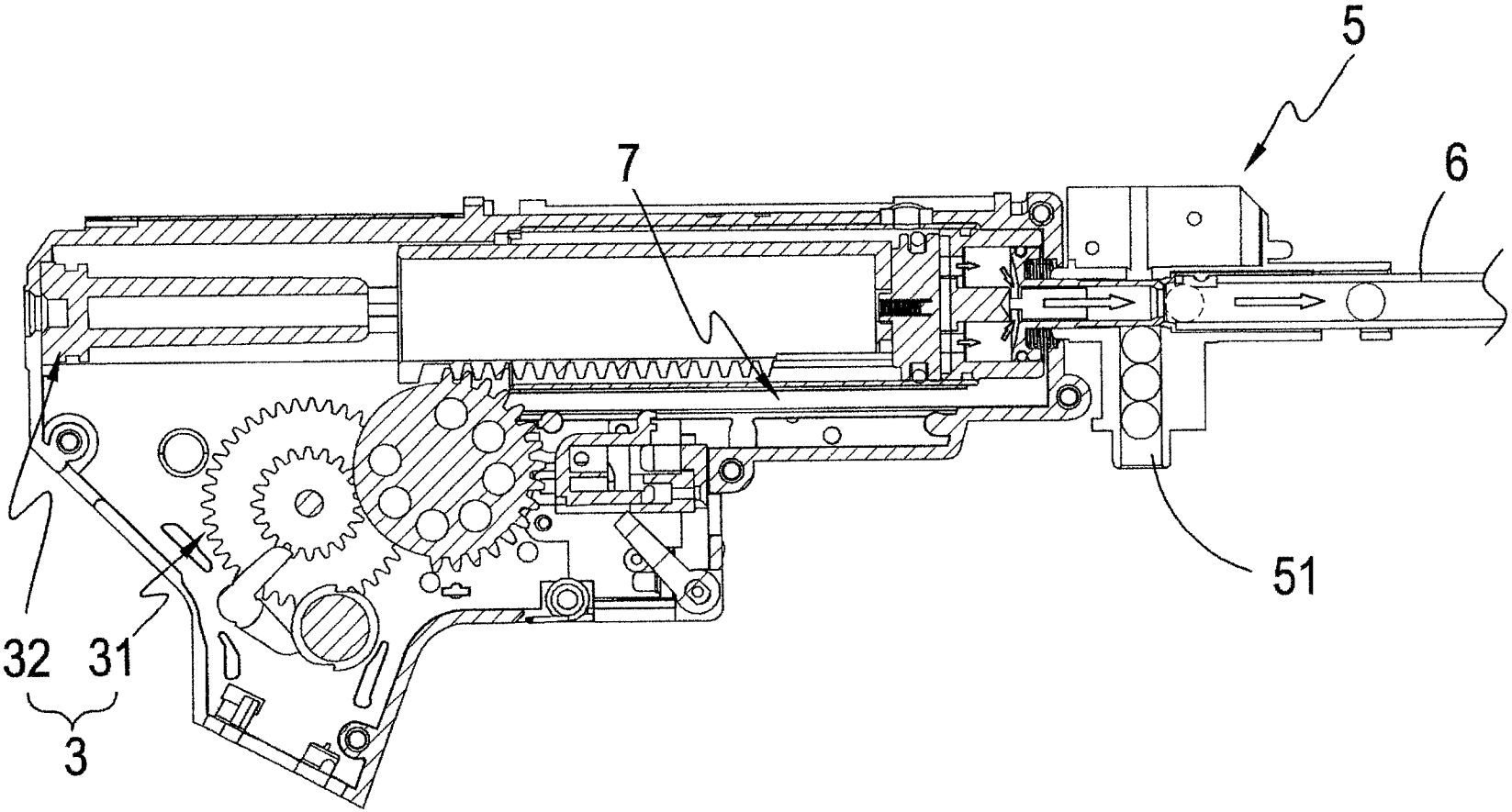
FIG. 3A is another schematic view showing the embodiment of the present invention.
Figure 3B:
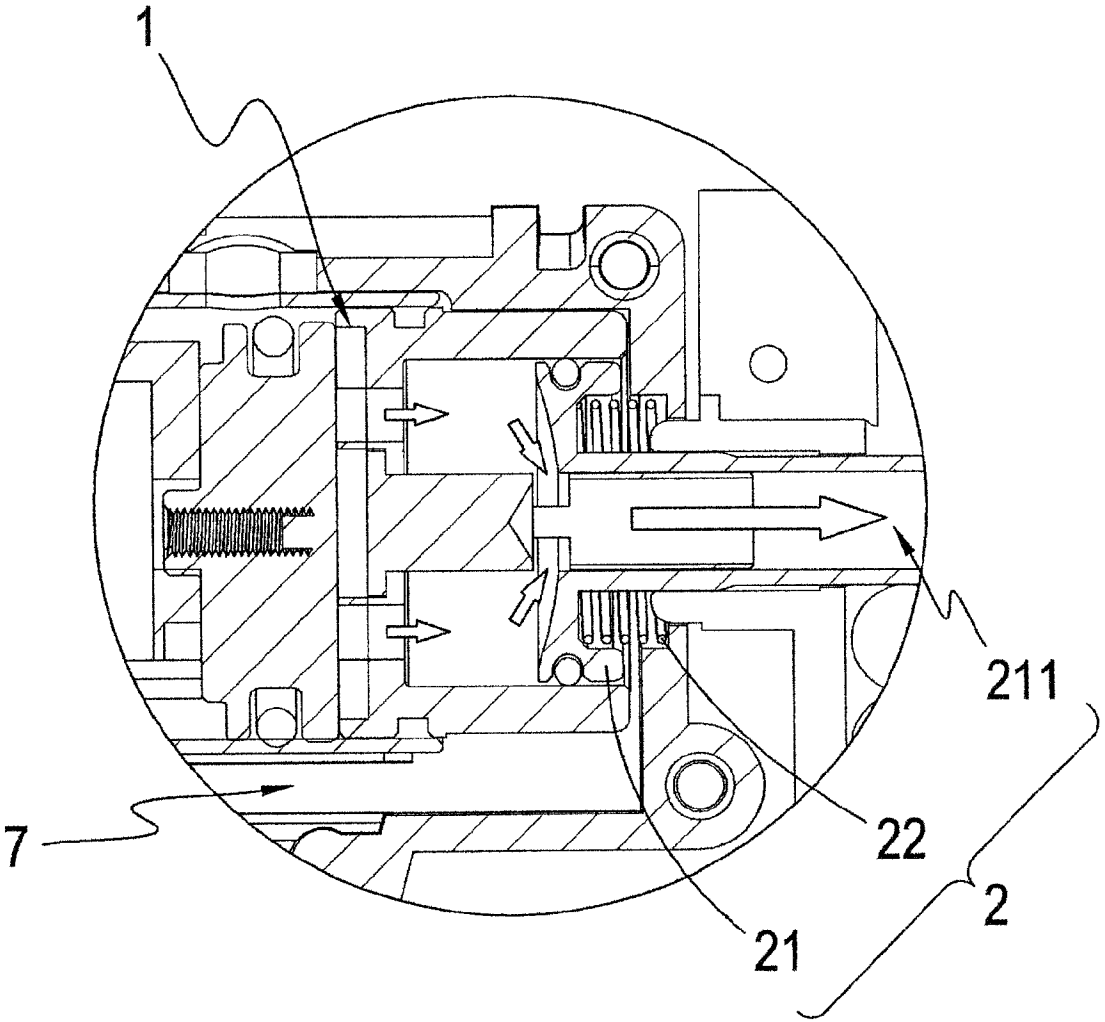
FIG. 3B is an enlarged view of the embodiment of the present invention.
Figure 3C:
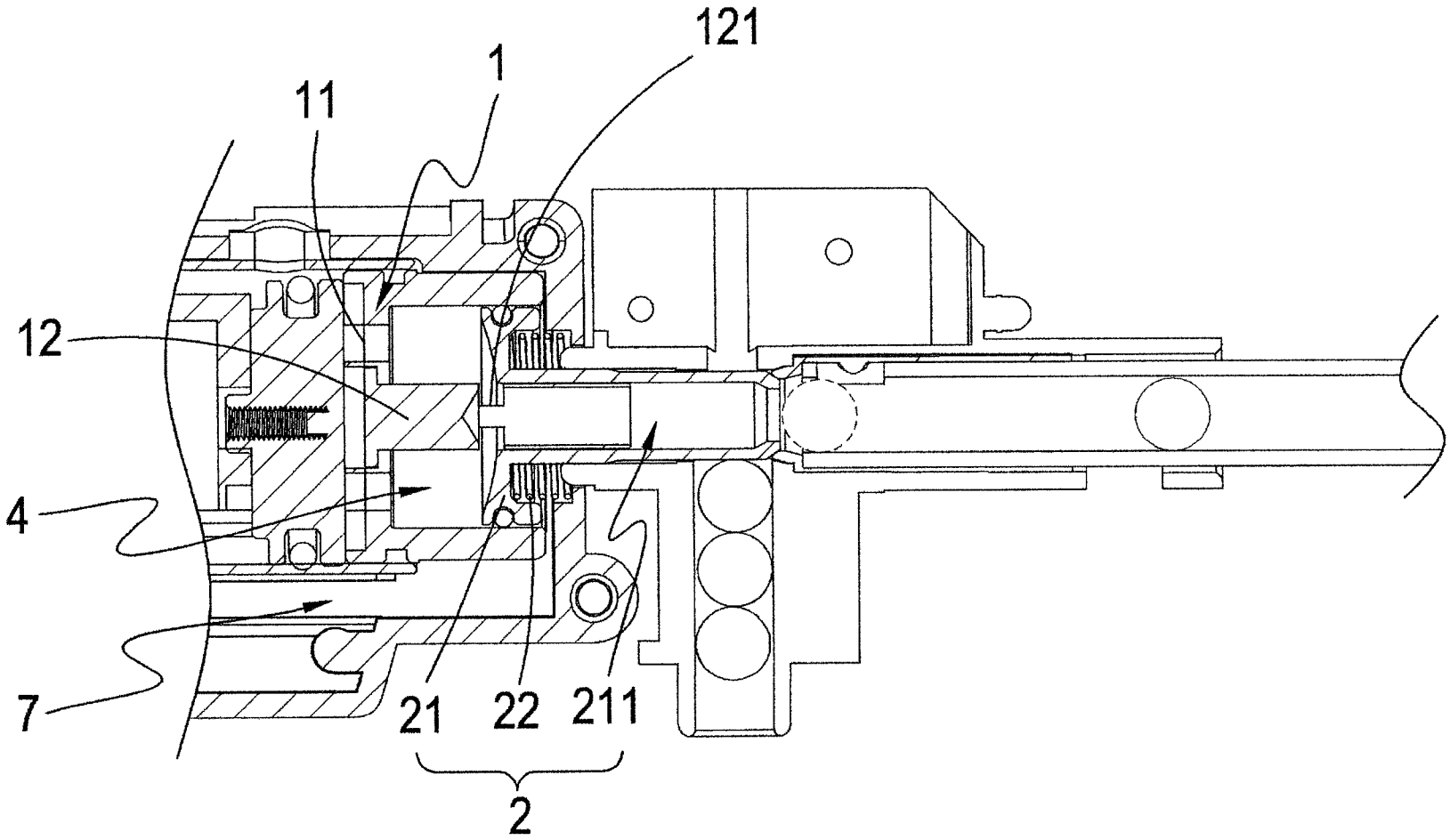
FIG. 3C is another partial schematic view of the embodiment of the present invention.

Referring to FIG. 2A-3C, which are respectively an schematic view, an enlarged view, a partial schematic view, another schematic view, another enlarged view, and another partial schematic view of an embodiment according to the present invention, a pressure differential bullet advancing structure according to the present invention is used in a toy gun and comprises an expansion device 1, a collar device 2, and a pneumatic module 3. The pneumatic module 3 is arranged at one side of the expansion device 1. The pneumatic module 3 generates high-pressure air, which is supplied to flow through the expansion device 1 and the collar device 2. The pneumatic module 3 comprises a power device (not labeled), a transmission module 31 coupled to the power device, and a piston module 32 that is operable in coordination with the transmission module 31. The piston module 32 is arranged beside the expansion device 1. The collar device 2 is slidably received in the expansion device 1 and the collar device 2 is structurally to fit over a portion of the expansion device 1. The collar device 2 functions to advance BB bullets in sequence. The collar device 2 comprises at least one ejection seat 21 and at least one elastic element 22 that encompasses a portion of the ejection seat 21 that is distant from the expansion device 1. The ejection seat 21 comprises at least one air ejection bore 211 formed therein and movably and partially fit over the expansion device 1 for the high-pressure air to flow therethrough. The expansion device 1 comprises at least one through hole 11 through which the high-pressure air may flow. The expansion device 1 and the collar device 2 define therebetween an expandable chamber 4 in such a way that the expandable chamber 4 communicates with the through hole 11. At least one spare space 7 is formed below the expansion device 1. The expansion device 1 comprises at least one guide bar 12 that is arranged distant from the pneumatic module 3 to be slidably receivable in the collar device 2. The guide bar 12 has a circumferential wall in which at least one the air inlet opening 121 is formed. The air inlet opening 121 is arranged to extend away from the pneumatic module 3 to define a passage through which the high-pressure air may flow. The air inlet opening 121 is selectively shielded by the collar device 2. The end portion of the ejection seat 21 of the collar device 2 that is distant from the expansion device 1 is slidably received in at least one bullet feeding module 5 that comprises at least one bullet accommodation space 51 formed therein for receiving BB bullets. The ejection seat 21 is operable to selectively block the bullet accommodation space 51. The bullet feeding module 5 is coupled to at least one barrel element 6 at the side thereof distant from the ejection seat 21.

When the present invention is put into operation (in which solid arrows in the drawings indicate moving direction of components of the toy gun and hollow arrows indicate direction of airflow), the power device supplies power through the transmission module 31 to the pneumatic module 3 to cause the piston module 32 to move forward rapidly and compress air the generate high-pressure air. The high-pressure air flows through the through hole 11 of the expansion device 1 into the expandable chamber 4, whereby the high-pressure air flowing into the expandable chamber 4 applies a force to the collar device 2 to move the ejection seat 21 forward so that the ejection seat 21 pushes and advances one of the BB bullets of the bullet accommodation space 51 (that is in a standby position) toward the barrel element 6 to reach a ready-to-shoot position. Under this condition, the ejection seat 21 is positioned to block the standby position of the bullet accommodation space 51. With the ejection seat 21 continuously moving forward to expose the air inlet opening 121 that is formed in the circumferential surface of the guide bar 12, the high-pressure air is allowed to flow through the air inlet opening 121 and move in the direction of extension of the air inlet opening 121 to get into the air ejection bore 211, whereby the high-pressure air blows toward the BB bullet at the ready-to-shoot position in the barrel element 6 to shoot out the BB bullet. Under such a condition, the interior pressure of the expandable chamber 4 drops down to such an extent that the elastic element 22 forces the ejection seat 21 to move backward to the home position so that the air inlet opening 121 is shielded again and the ejection seat 21 no longer blocks the bullet accommodation space 51 (namely the standby position) to allow the next one of the BB bullets contained in the bullet accommodation space 51 is caused by the bullet feeding module 5 to get to the standby position for the next cycle of shooting.

Since no conventional transmission link member is needed in the present invention, the spare space 7 in which the transmission link member was supposed to set is now available for additionally mounting various components/parts, such as an electrical chip.

The pressure differential bullet advancing structure of toy gun according to the present invention has the following features that provide advantages over the known devices:

(1) The arrangement of combination of the expansion device 1 and the collar device 2 provides the present invention with practical advantages of reducing the number of components/parts needed, reducing cost, and reducing the amount of interior space needed.

(2) The arrangement of combination of the expansion device 1 and the collar device 2 provides the present invention with practical advantages of reducing the chance of malfunctioning and being easy to assemble and disassemble.

(3) The arrangement of combination of the expansion device 1 and the collar device 2 provides the present invention with a practical advantage of reducing the loading of the power device It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A pressure differential bullet advancing structure of a toy gun, which is adapted to advance BB bullets in sequence, the pressure differential bullet advancing structure comprising:

an expansion device;

a collar device, which is slidably received in the expansion device and is fit over a portion of the expansion device, the collar device being operable to move the BB bullets in sequence; and a pneumatic module, which is set at one side of the expansion device to generate high-pressure air that is allowed to flow through the expansion device and the collar device.

2. The pressure differential bullet advancing structure according to claim 1, wherein the pneumatic module comprises a power device, a transmission module coupled to the power device, and a piston module operable in coordination with the transmission module, the piston module being arranged beside the expansion device.

3. The pressure differential bullet advancing structure according to claim 1, wherein the expansion device comprises at least one through hole through which the high-pressure air is movable.

4. The pressure differential bullet advancing structure according to claim 3, wherein the expansion device and the collar device define therebetween an expandable chamber in such a way that the expandable chamber communicates with the through hole.

5. The pressure differential bullet advancing structure according to claim 1, wherein the expansion device comprises at least one guide bar that is arranged distant from the pneumatic module to be slidably receivable in the collar device, the guide bar having a circumferential surface in which at least one the air inlet opening is formed, the air inlet opening being arranged to extend in a direction away from the pneumatic module to define a passage through which the high-pressure air is movable.

6. The pressure differential bullet advancing structure according to claim 5, wherein the air inlet opening is selectively shieldable by the collar device.

7. The pressure differential bullet advancing structure according to claim 1, wherein the collar device comprises at least one the ejection seat and at least one elastic element that encompasses a portion of the ejection seat that is distant from the expansion device, the ejection seat comprising at least one air ejection bore formed therein and movably and partially fit over the expansion device for the high-pressure air to flow therethrough.

8. The pressure differential bullet advancing structure according to claim 7, wherein an end portion of the ejection seat that is distant from the expansion device is slidably received in at least one bullet feeding module that comprises at least one bullet accommodation space formed therein for receiving the BB bullets, the ejection seat being operable to selectively block the bullet accommodation space.

9. The pressure differential bullet advancing structure according to claim 8, wherein the bullet feeding module is coupled to at least one barrel element at a side thereof distant from the ejection seat.

10. The pressure differential bullet advancing structure according to claim 1, wherein at least one spare space is formed below the expansion device.

* * * * *